US006919912B2

(12) United States Patent
Huang et al.

(10) Patent No.: US 6,919,912 B2
(45) Date of Patent: Jul. 19, 2005

(54) METHOD OF REGISTERING THE POSITION OF A RIBBON MOVING AT A CONSTANT ANGULAR VELOCITY AND DETECTING THE AMOUNT OF THE RIBBON USED IN A PHOTO PRINTER

(75) Inventors: Kuan-Chih Huang, Taipei Hsien (TW); Kuang-Huei Huang, Taipei (TW)

(73) Assignee: Hi-Touch Imaging Technologies Co., Ltd., Pan-Chiao (TW)

( * ) Notice: Subject to any disclaimer, the term of this patent is extended or adjusted under 35 U.S.C. 154(b) by 72 days.

(21) Appl. No.: 10/605,809

(22) Filed: Oct. 29, 2003

(65) Prior Publication Data

US 2005/0041089 A1 Feb. 24, 2005

(30) Foreign Application Priority Data

Aug. 20, 2003 (TW) ..... 92122824 A

(51) Int. Cl.[7] ..... B41J 33/14
(52) U.S. Cl. ..... 347/217
(58) Field of Search ..... 347/217, 213, 347/226, 215, 171, 172, 177, 178; 400/234, 223, 120.01, 120.02, 120.04, 118.3

(56) References Cited

U.S. PATENT DOCUMENTS 4,408,908 A * 10/1983 Applegate et al. ..... 400/118.3
5,533,819 A * 7/1996 Watanabe et al. ..... 400/226
6,292,207 B1 * 9/2001 Sogabe ..... 347/217
6,315,471 B1 * 11/2001 Hsieh et al. ..... 400/234

* cited by examiner

*Primary Examiner*—K. Feggins
(74) *Attorney, Agent, or Firm*—Winton Hsu

(57) ABSTRACT

A method of registering the position of a ribbon by moving the ribbon with a constant angular velocity and detecting the amount of ribbon used in a photo printer. The ribbon includes dye regions each having several dye frames, and black bar regions each prior to a dye region. The first dye frame of each dye region is registered after each black bar region is detected. The amount of ribbon used is determined based on the moved time of the black bar region. And while one of the dye frames is finished printing, the required time for moving the ribbon to register the start position of the subsequent dye frame is obtained based on the moved time of the black bar region, the length of the printed part of the dye frame, and the length from non-printed part of the dye frame to the subsequent dye frame.

11 Claims, 9 Drawing Sheets

METHOD OF REGISTERING THE POSITION OF A RIBBON MOVING AT A CONSTANT ANGULAR VELOCITY AND DETECTING THE AMOUNT OF THE RIBBON USED IN A PHOTO PRINTER

BACKGROUND OF INVENTION

1. Field of the Invention

The present invention relates to a photo printer, and more specifically, to a photo printer which is operated with a constant angular velocity, capable of registering the used color of the ribbon, and capable of detecting the amount of the ribbon used.

2. Description of the Prior Art

Along with the development of digital cameras, photo printers, which are able to print photos directly, become popular.

Please refer to FIG. 1 in conjunction with FIG. 2. FIG. 1 is a schematic diagram of a color printer 10 according to the prior art. FIG. 2 is a cross-sectional view of the printer 10 depicted in the FIG. 1 along the line 2—2. The color printer 10 can be a photo printer for printing photos. The printer 10 comprises a ribbon 20, a light source 22, a photo sensor 24, a heat printhead 26, and a controller 30. The ribbon 20 is rotatable in a ribbon-driving device (not shown in FIGS. 1 and 2). The controller 30 is used for registering the position of the ribbon 20 in order to control the printer 10 in operation.

Please refer to FIG. 3. FIG. 3 is a schematic diagram of the ribbon and the photo sensor structures in the printer 10. The ribbon 20 contains a plurality of dye regions 40 in order. Each dye region 40 contains dye frames 32, 34, 36, 38 with different colors, such as the dye frame 32 with yellow; the dye frame 34 with magenta; the dye frame 36 with cyan; and the dye frame 38 being an over-coating. Each yellow dye frame 32 is equipped with a black bar region 44 in the front. Moreover, a transparent separation region 45 without any color is located between each of the dye frames 32, 34, 36, 38. The black bar region 44 and the transparent separation region 45 are used for distinguishing each start position of the dye frames 32, 34, 36, 38 by using the controller 30. The lengths of the dye frames are much longer than those of the black bar region 44 and the transparent separation region 45.

As shown in FIG. 3, after the light source 22 irradiates the ribbon 20 with the beam 25, the photo sensor 24 senses the beam 25 penetrating the dye region 40 and generates corresponding sensing signals. Because of different penetrability of the dye frames 32, 34, 36, 38, and the black bar region 44 to the beam 25, the photo sensor 24 generates different sensing voltages when passed by two adjacent dye frames one after another. The controller 30, however, registers the positions of the dye region 40 and the dye frames 32, 34, 36, 38 in the dye region 40 according to the keeping time of the sensing voltage generated by the photo sensor 24. And the heat printhead 26 is used to transfer the dye of the ribbon 20 onto a medium.

Because the controller 30 can determine which dye frame is passing due to different penetrability of each dye frame in the dye region 40, the controller 30 is able to register the positions of the dye frames 32, 34, 36, 38 on the dye region 40 of the ribbon 20 by distinguishing four different sensing voltages. However, the yellow dye frame 32 generates the same sensing voltage with the over-coating dye frame 38. As a result, the controller 30 is required for discerning the order of the other two dye frames (the magenta dye frame 34 and the cyan dye frame 36) to distinguish the yellow dye frame 32 from the over-coating frame 38. The other way is arrange specific bar codes in the front of the yellow dye frame 32 and the over-coating dye frame 38 to distinguish between them. Except determining the amount of the dye region 40 of the ribbon 20, the controller 130 is only able to determine the positions of each dye frame in the dye region 40. After running out of the ribbon 20, if the printer 10 is still used without replacing the ribbon 20, the printer is likely to cease printing in the printing process and bewilder users.

SUMMARY OF INVENTION

It is therefore a primary object of the present invention to provide a photo printer which is operated with a constant angular velocity, capable of registering the used color of the ribbon, and detecting the amount of the ribbon used, to solve the above-mentioned problem.

According to the claimed invention, a method of registering the position of a ribbon by moving the ribbon with a constant angular velocity and detecting the amount of ribbon used in a photo printer is disclosed. The ribbon includes a plurality of dye regions each having a plurality of dye frames. The ribbon moves in a predetermined direction with a constant angular velocity, and a photo sensor for generating a sensing signal corresponding to the dye frames. The sensing signal has a first status with a low level voltage and a second status with a high level voltage. The method detects the length of time of the first status when the sensing signal changes its status from the second status to the first status. If the length of time of the first status is shorter than a threshold, the first dye frame of the dye region is registered, and the method then determines the amount of ribbon used based on the length of time of the first status. While one of the dye frames of the dye region is finished printing, the method determines the required moving time for the ribbon to register the start position of the subsequent dye frame of the dye region based on the length of time of the first status used to register the first dye frame of a dye region, the total length of the printed part of the dye frame, and the length from a non-printed part of the dye frame to the subsequent dye frame.

These and other objectives of the claimed invention will no doubt become obvious to those of ordinary skill in the art after reading the following detailed description of the preferred embodiment, which is illustrated in the various figures and drawings.

DETAILED DESCRIPTION

Figure 1:
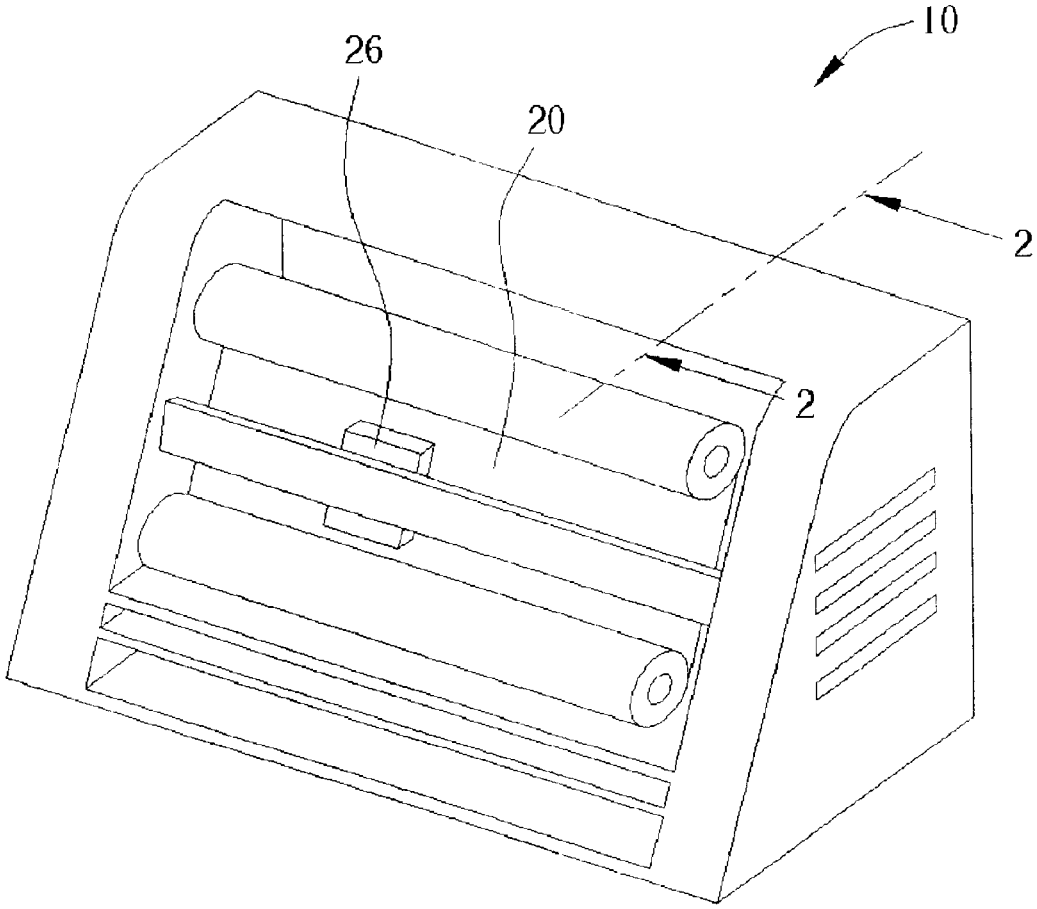
Fig. 1 Prior Art
FIG. 1 is a schematic diagram of a color printer according to the prior art.
Figure 2:
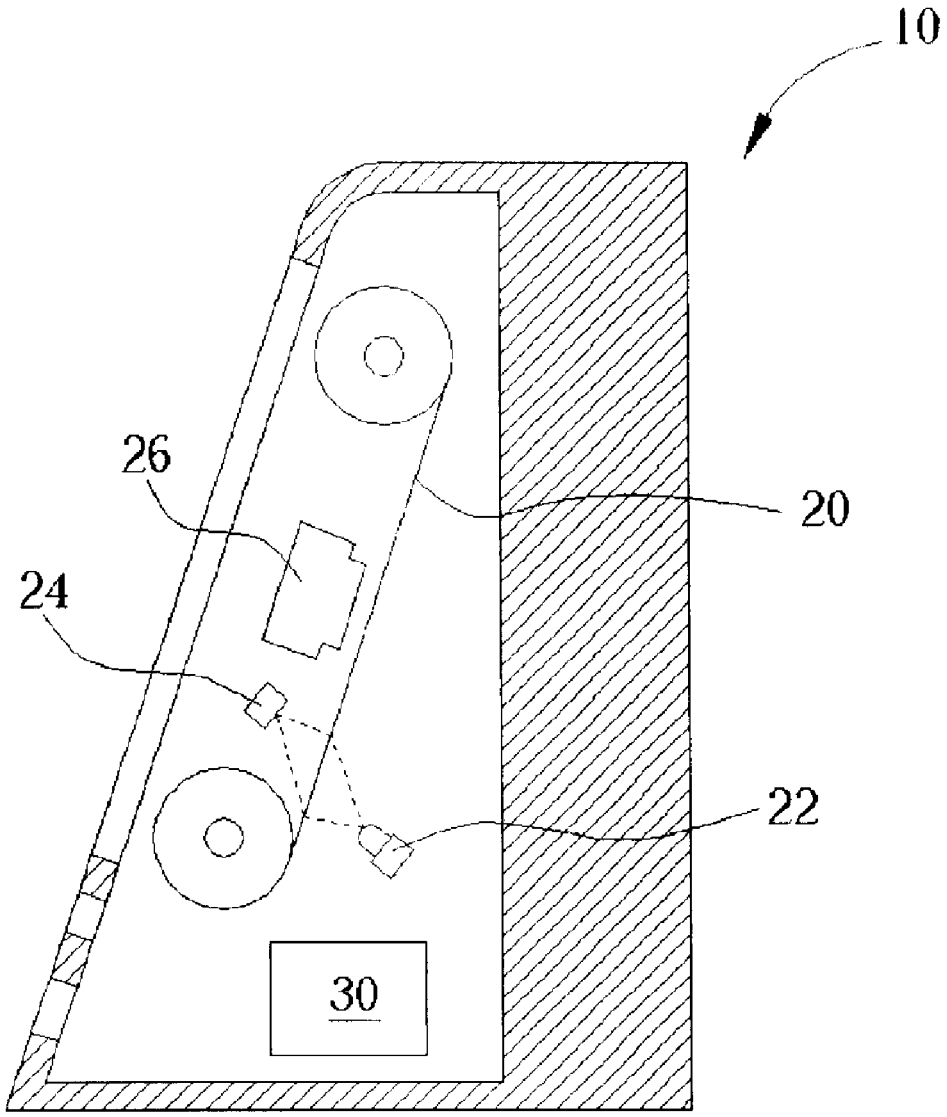
Fig. 2 Prior Art
FIG. 2 is a cross-sectional view of the printer depicted in the FIG. 1 along the line 2—2.
Figure 3:
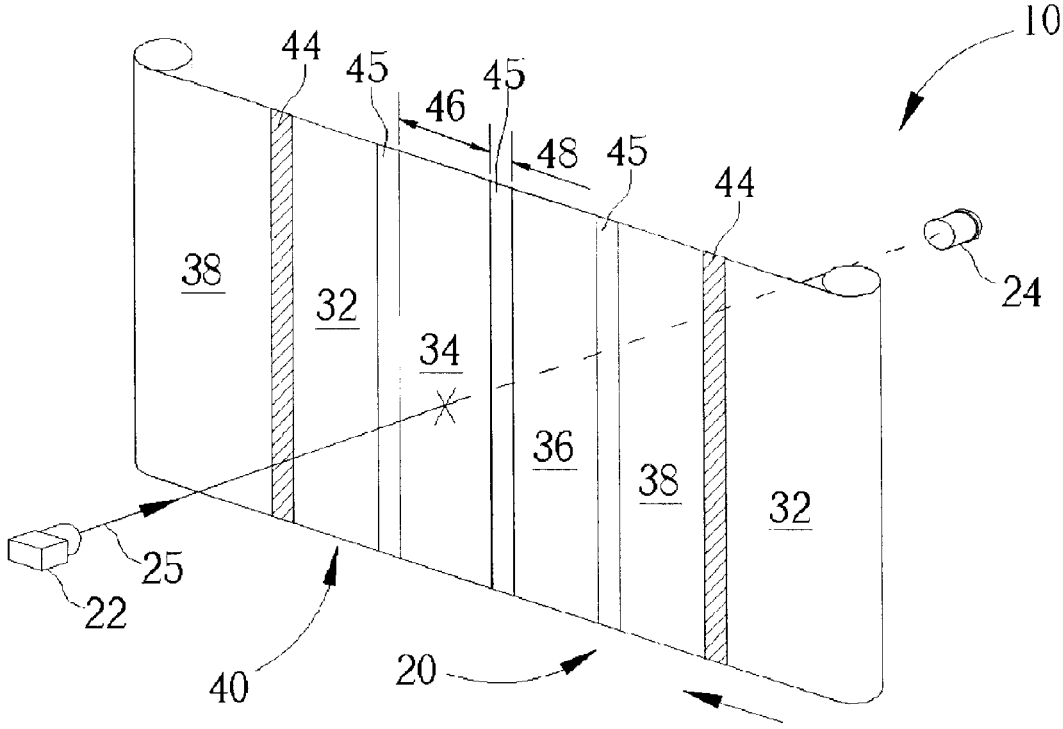
Fig. 3 Prior Art
FIG. 3 is a schematic diagram of the ribbon and the photo sensor structures in the printer depicted in the FIG. 1.
Figure 4:
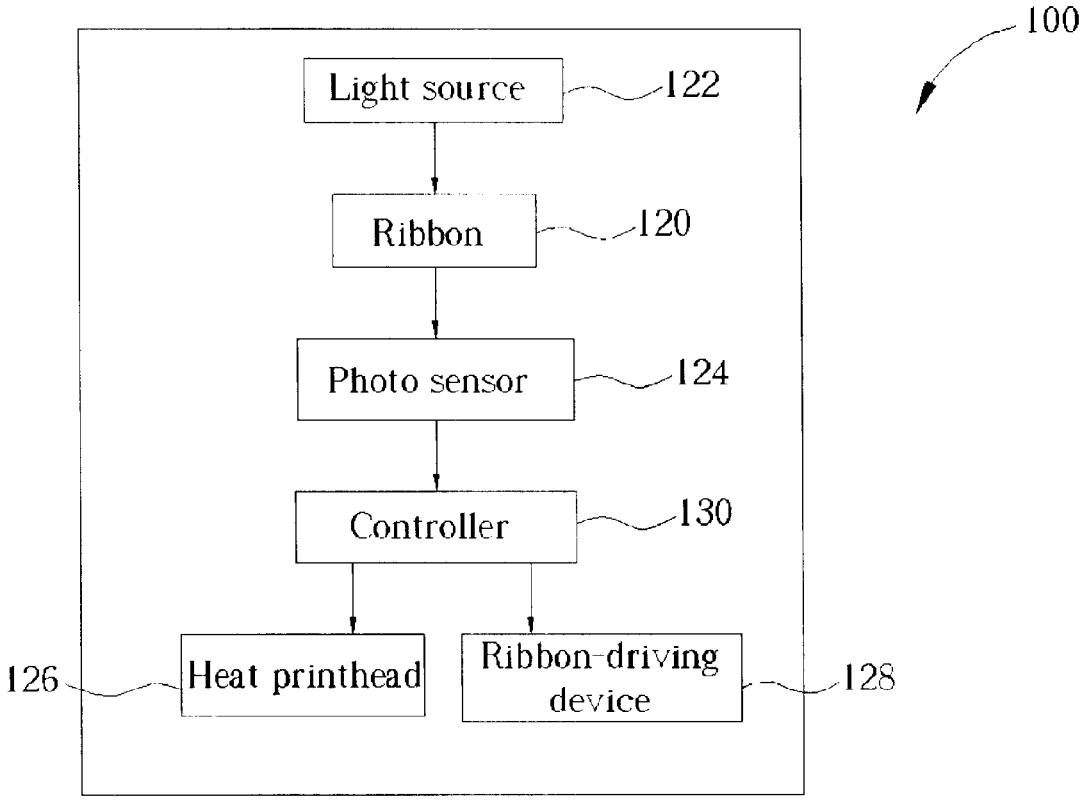
FIG. 4 is a functional block diagram of a photo printer according to the present invention.
Figure 5:
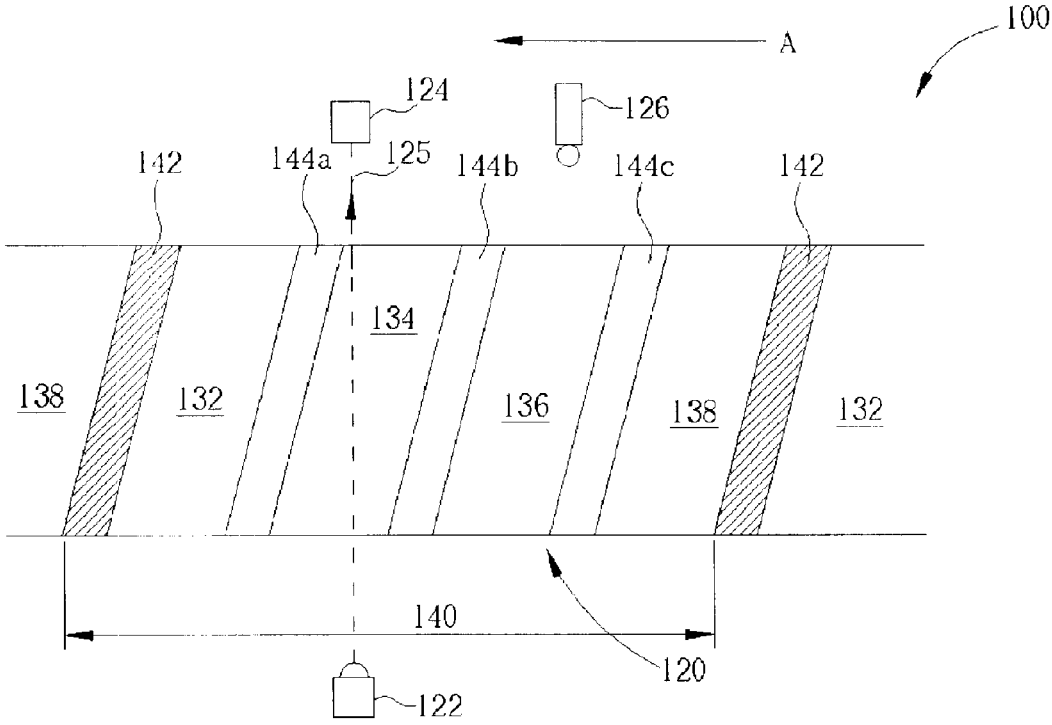
FIG. 5 is a graph showing the relative position of the ribbon, the photo sensor, and the printhead of the photo printer shown in FIG. 4.

Please refer to FIG. 4 and FIG. 5 together. FIG. 4 is a functional block diagram of a photo printer 100 according to the present invention. FIG. 5 is a graph showing the relative position of the ribbon, the photo sensor, and the printhead of the photo printer 100 shown in FIG. 4. The printer 100 is a photo printer for printing photos. The printer 100 comprises a ribbon 120, a light source 122, a photo sensor 124, a heat printhead 126, a ribbon-driving device 128, and a controller 130. The ribbon-driving device 128 comprises a take-up spool 114 and a supply spool 116 (shown in FIG. 6). The ribbon 120 is taped on the take-up spool 114 and the supply-spool 116. As a result, the ribbon 120 is able to move due to a rotation of the take-up spool 114 and the supply-spool 116. In addition, the controller 130 is used for registering the position of the ribbon 120 in order to control the operation of the printer 100.

The ribbon 120 comprises a plurality of dye regions 140 in order. Each dye region 140 contains dye frames 132, 134, 136, 138 with different colors, such as the dye frame 132 with yellow; the dye frame 134 with magenta; the dye frame 136 with cyan; and the dye frame 138 being an over-coating dye frame. Each of the dye frames 132, 134, 136, and 138 is equipped with the separation regions 142, 144*a*, 144*b*, 144*c* in the front. The separation region 142 is black, and the other separation regions 144*a*, 144*b*, and 144*c* are transparent without any color. The lengths of the dye frames 132, 134, 136, 138 are much longer than that of the separation region 142, 144*a*, 144*b*, 144*c*. The controller 130 is used for controlling the photo printer 100 in operation in order to count and record the moving time of the ribbon 120. The heat printhead 126 is used for transferring the dye on the ribbon 120 onto the photos. The ribbon 120 moves at constant angular velocity, so that the heat printhead 126 is capable of transferring the dye on the dye frames 132, 134, 136, 138 in order onto a medium to generate a color pattern.

As shown in FIG. 5, the light source 122 of the photo printer 100 can be a green light emitting diode (LED) set on one side of the ribbon 120. The light source 122 is used for emitting beam 125 onto the ribbon 120, and the photo sensor 124 is set on the other side of the ribbon 120 to sense the beam 125 passing through the ribbon 120 to generate corresponding sensing signals. When the ribbon 120 moves in the direction of arrow A, sensing signals corresponding to different dye frames 140 of the ribbon 120 are generated by the photo sensor 124.

Because of higher penetrability of the beam 125 against the yellow dye frame 132, over-coating dye frame 138, and the transparent separation regions 144*a*, 144*b*, 144*c*, a sensing signal with high level voltage is generated while the beam 125 is penetrating these dye frames 132, 138 or separation regions 144*a*, 144*b*, 144*c*. On the contrary, because of lower penetrability of the beam 125 against the magenta dye frame 134, the cyan dye frame 136, and the black bar region 142, a sensing signal with low level voltage is generated when the green beam 125 is penetrating these dye frames 134, 136, or the black bar region 142.

According to the present embodiment, while receiving status of the sensing signal from the photo sensor 124 is changed, the controller 130 records the changed status time Td of the sensing signal and compares the time Td with a threshold time Tth. For instance, while sensing the change of the sensing signal from high to low level, the controller 130 records the time Td in which the sensing signal is in the low level. The region corresponding to the sensing signal with low level is determined to be the black bar region 142 as long as it is detected that the time Td in the low level is shorter than the threshold time Tth. If detecting that the time Td in the low level is longer than the threshold time Tth, it means that the region corresponding to the sensing signal with low level is a magenta or cyan dye frame. At this moment, the controller 130 will ignore the time Td. As long as the controller 130 ensures that the time Td in the low level is shorter than the threshold time Tth, the yellow dye frame in a dye region has been registered. And the amount of the ribbon 120 used is able to be calculated according to the time Td. The details of the determination are as follows.

Figure 6:
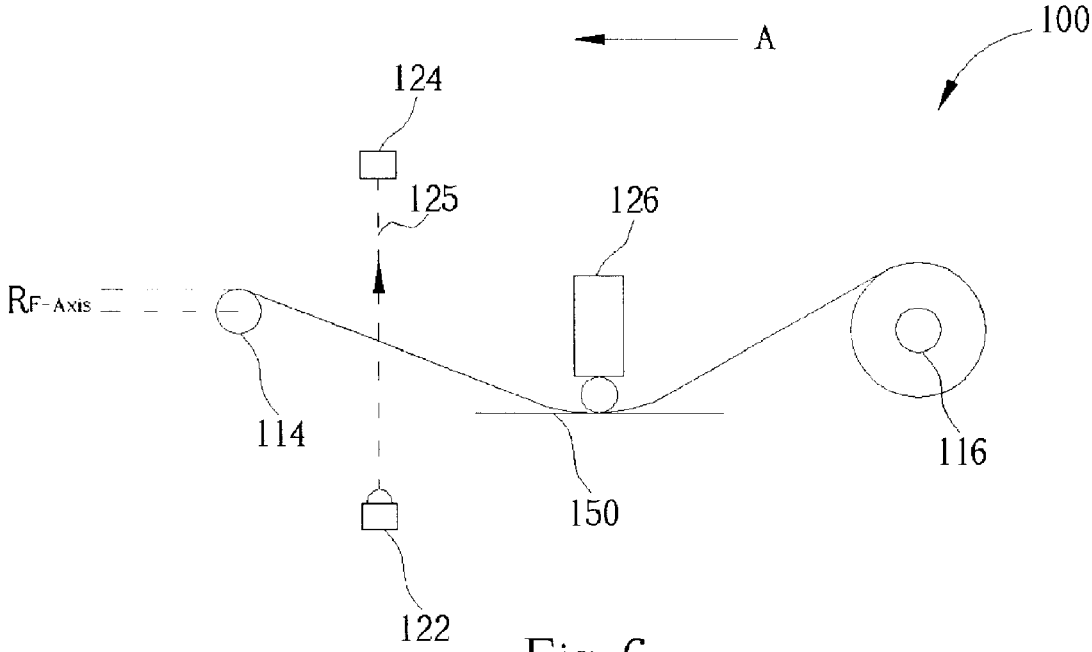
FIG. 6 is a schematic diagram of the ribbon before printing.
Figure 7:
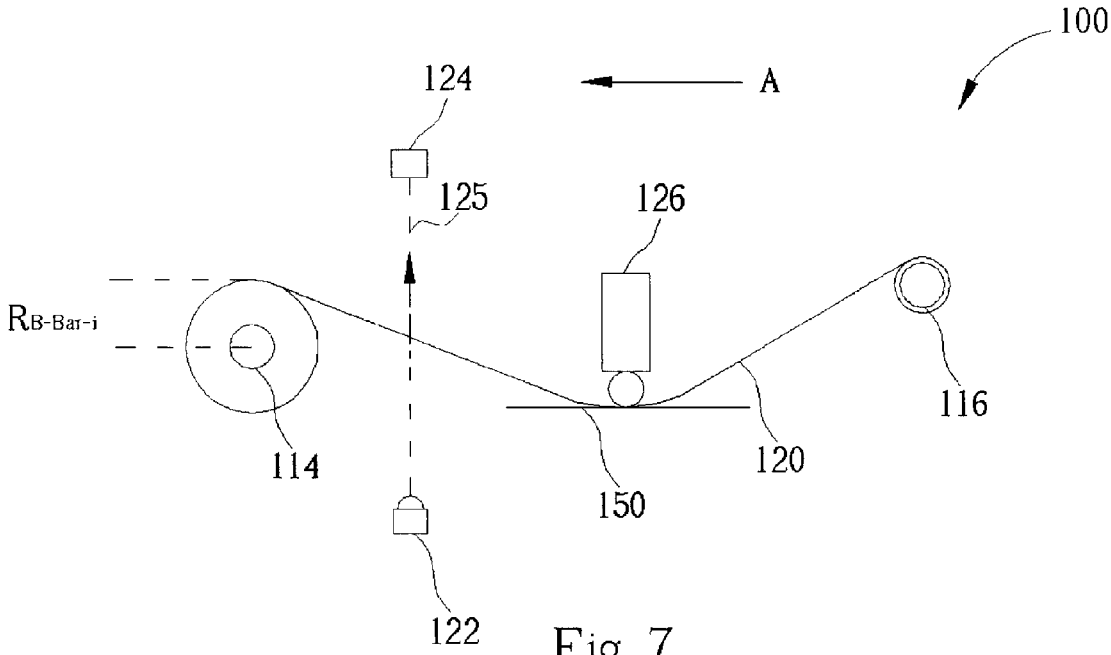
FIG. 7 is a schematic diagram of the ribbon during printing.

Please refer to FIG. 4, FIG. 6, and FIG. 7. FIG. 6 is a schematic diagram of the ribbon 120 before printing. FIG. 7 is a schematic diagram of the ribbon 120 during printing. From FIGS. 6 and 7, when the controller 130 ensures that the time Td in the low level is shorter than the threshold time Tth, this means that a black bar region 142 is passing through the photo sensor 124. At this time, the time Td is represented by $T_{B\text{-}Bar\text{-}i}$, which means the time it takes for the black bar region 142 of the i dye region 140 to pass through the photo sensor 124.

$$L_{B\text{-}Bar}=R_{B\text{-}Bar\text{-}i}\square\square\times T_{B\text{-}Bar\text{-}i} \quad \text{(Equation 1)}$$

Where $L_{B\text{-}Bar}$ stands for the length of the black bar region 142;

$R_{B\text{-}Bar\text{-}i}$ stands for the radius of the ribbon 120 included by the take-up spool 114 while the black bar region 142 of the $i_{th}$ dye region passes through the photo sensor 124.

ω stands for the angular velocity; and $T_{B\text{-}Bar\text{-}i}$ stands for the time it takes for the black bar region 142 of the $i_{th}$ dye region 140 to pass through the photo sensor 124.

Because ω and $L_{B\text{-}Bar}$ are constant, and $T_{B\text{-}Bar\text{-}i}$=Td. As a result, $R_{B\text{-}Bar\text{-}I}$ is calculated.

From FIG. 6 and FIG. 7, there concludes a following equation:

$$\pi R_{B\text{-}Bar\text{-}i}^2-\pi R_{F\text{-}Axis}^2=i\times L_{Set}\times d \quad \text{(Equation 2)}$$

where i stands for the index of the dye region 140 of the ribbon 120;

$L_{set}$ stands for the length of the dye region 140;

$R_{F\text{-}Axis}$ stands for the radius of the take-up spool 114; and d stands for the thickness of the ribbon 120.

Because $R_{F\text{-}Axis}$, $L_{set}$, and d are constant, the number of i is able to be calculated with B-Bar-i from equation 1. The controller 130 is able to determine which of the dye regions 140 the black bar region 142 passing through the photo sensor 124 belongs to. As a result, the number of the consumed dye regions 140 is calculated. After running out one of the yellow dye frame 132, the start position of the magenta dye frame 134 must be registered.

Figure 8:
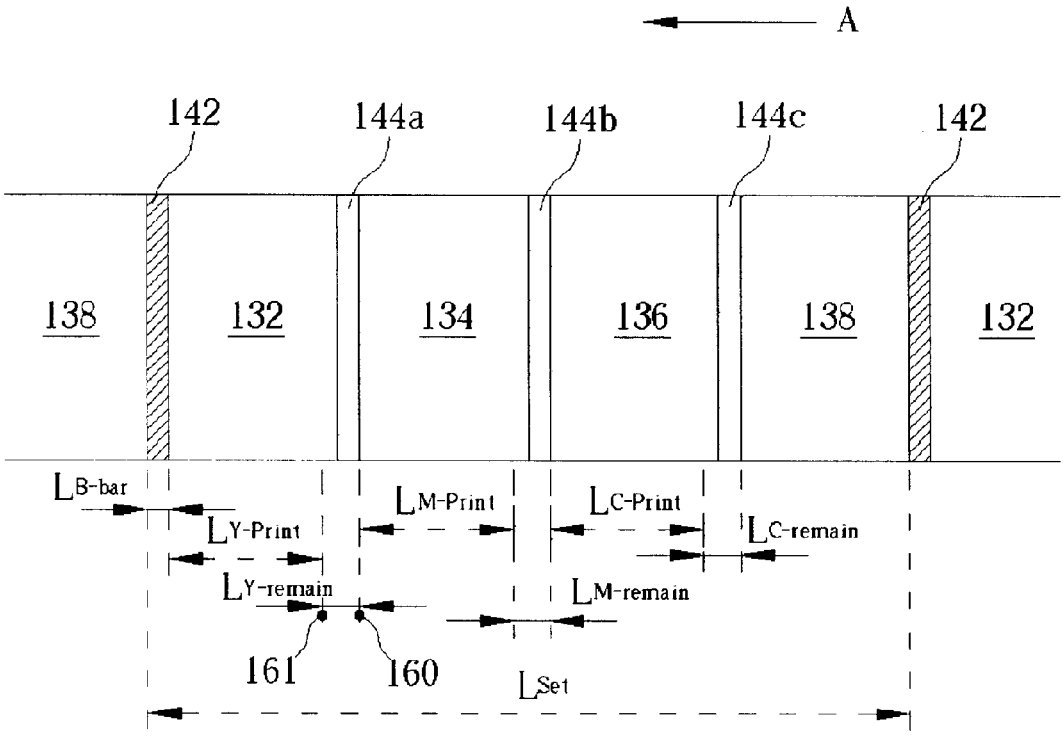
FIG. 8 is a schematic diagram of the printing length of each dye frame and the length from the printed dye frame to the next dye frame.

Please refer to FIG. 8. FIG. 8 is a schematic diagram of the printing length of each dye frame and the length from the printed dye frame to the next dye frame. $L_{set}$ stands for the length of the dye region 140. $L_{Y\text{-}Print}$, $L_{M\text{-}Print}$, $L_{C\text{-}Print}$ stand for the lengths to be printed for the yellow, magenta, and cyan frames. $L_{Y\text{-}remain}$, $L_{M\text{-}remain}$, $L_{C\text{-}remain}$ respectively stand for the remaining lengths from the yellow, magenta, and cyan dye framesto be printed to the next dye frames (i.e. magenta, cyan, and protection dye frame). And $L_{B\text{-}Bar}$ stands for the length of the black bar-region 142.

$L_{Y\text{-}Print}$ is given, which stands for the length the yellow dye frame 132 after being printed by the heat printhead 126. Because the heat printhead 126 is on the position 161 shown in FIG. 8 after running out of the yellow dye frame 132, the start position of the following magenta dye frame 134 is on the position 160 shown in the FIG. 8. And $L_{Y\text{-}remain}$ is the length from the position 160 to 161, which stands for the length from the heat printhead 126 to the subsequent magenta dye frame 134.

$$L_{Y\text{-}remain}=R_{Y\text{-}remain}\times\omega\times T_{Y\text{-}remain\text{-}i} \quad \text{(Equation 3)}$$

$$L_{B\text{-}Bar}=R_{B\text{-}Bar\text{-}i}\times\omega\times T_{B\text{-}Bar\text{-}i} \quad \text{(Equation 4)}$$

$T_{Y\text{-}remain\text{-}i}$ and $T_{B\text{-}Bar\text{-}i}$ respectively stand for the time it takes for $L_{Y\text{-}remain}$ and $L_{B\text{-}Bar}$ to pass through the photo sensor 124. Because of constant angular velocity, $$T_{Y-remain-i}=\frac{(L_{Y-remain}\times R_{B-Bar-i})\times T_{B-Bar-i}}{(L_{B-Bar}\times R_{Y-remain})} \quad \text{(Equation 5)}$$

equation 5 is made by combining equations 3 and 4.

Because the ribbon is very thin, $R_{B\text{-}Bar\text{-}i}$ is assumed to be equal to $R_{Y\text{-}remain}$. As a result, equation 5 is able to be simplified as $$T_{Y\text{-}remain\text{-}i}=L_{Y\text{-}remain}\times T_{B\text{-}Bar\text{-}i}|L_{B\text{-}Bar}. \quad \text{(Equation 6)}$$

As mentioned before, the controller 130 has measured the time $T_{B\text{-}Bar\text{-}i}$ in which the $i_{th}$ black bar region passes through the photo sensor, and $L_{Y\text{-}remain}$ and $L_{B\text{-}Bar}$ are known. As a result, the time $T_{Y\text{-}remain\text{-}i}$, which means the time it takes for the ribbon 120 moving with constant angular velocity to register the start position of the magenta dye frame, is obtained.

Similarly, the $L_{M\text{-}Print}$ is given, which stands for the length the magenta dye frame 134 after being printed by the heat printhead 126. And $L_{M\text{-}remain}$ which stands for the length from the heat printhead 126 to the subsequent cyan dye frame 136 is calculated by using following equations:

$$L_{M-remain}=R_{M-remain}\times\omega\times T_{M-remain-i}$$

$$L_{B-Bar}=R_{B-Bar-i}\times\omega\times T_{B-Bar-i}$$

$$T_{M-remain-i}=\frac{(L_{M-remain}\times R_{B-Bar-i})\times T_{B-Bar-i}}{(L_{B-Bar}\times R_{M-remain})}$$

Because the ribbon is very thin, $R_{B\text{-}Bar\text{-}i}$ is assumed to be equal to $R_{M\text{-}remain}$. As a result, $$T_{M\text{-}remain\text{-}i}=L_{M\text{-}remain}\times T_{B\text{-}Bar\text{-}i}|L_{B\text{-}Bar}$$

As mentioned before, the controller 130 has measured the time $T_{B\text{-}Bar\text{-}i}$ in which the $i_{th}$ black bar region passes through the photo sensor, and $L_{M\text{-}remain}$ and $L_{B\text{-}Bar}$ are known. As a result, the time $T_{M\text{-}remain\text{-}i}$, which means the time it takes for the ribbon 120 moving with constant angular velocity to register the start position of the cyan dye frame 136, is obtained.

Similarly, the $L_{C\text{-}Print}$ is given, which stands for the length of the cyan dye frame 136 after being printed by the heat printhead 126. And $L_{C\text{-}remain}$ which stands for the length from the heat printhead 126 to the subsequent over-coating dye frame 138 is calculated in the same way as previous mathematical calculations with equations 3–6. As a result, $$T_{C\text{-}remain\text{-}i}=L_{C\text{-}remain}\times T_{B\text{-}Bar\text{-}i}|L_{B\text{-}Bar}$$

is concluded. In this way, the time $T_{C\text{-}remain\text{-}i}$, which means the time it takes for the ribbon 120 moving with constant angular velocity to register the start position of the over-coating dye frame 138, is obtained, based on $L_{C\text{-}remain}$, $L_{B\text{-}Bar}$, and the time $T_{B\text{-}Bar\text{-}i}$ in which the $i_{th}$ black bar region passes through the photo sensor.

Each time $T_{B\text{-}Bar\text{-}i}$, in which the $i_{th}$ black bar region passes through the photo sensor 124, can be obtained in advance. If lengths of $L_{Y\text{-}Print}$, $L_{M\text{-}Print}$, $L_{C\text{-}Print}$ are given, the times $T_{B\text{-}Bar\text{-}i}$, $T_{Y\text{-}remain\text{-}i}$, $T_{M\text{-}remain\text{-}i}$, $T_{C\text{-}remain\text{-}i}$ can also be obtained. Such pre-obtained values can be stored in a memory of the printer 100. In this way, if the controller 130 detects the changed status time Td of the sensing signal and compares the time Td with the stored time $T_{B\text{-}Bar\text{-}i}$, the amount of ribbon used and start position of each dye frame are easily obtained. Certainly, the controller 130 of the printer 100 can be designed to obtain such values as $T_{B\text{-}Bar\text{-}i}$, $T_{Y\text{-}remain\text{-}i}$, $T_{M\text{-}remain\text{-}i}$, $T_{C\text{-}remain\text{-}i}$, through above comparison and mathematical calculations.

The above illustrative embodiment uses the green light emitting diode to be the light source as illustration. In fact, the present invention is beyond this limit. Other light sources with various colors for irradiating the ribbon are also used. For example, the red light emitting diode is able to be the light source. When the red light source irradiates the yellow, the magenta, the over-coating dye frames and the transparent separation region, their sensing signal is under the second status. When the red light source irradiates the cyan dye frame and the black bar region, the sensing signal is under the first status. In fact, the light source can be any light emitting diodes with various colors. Because when any light source emits lights against yellow, the over-coating dye frames and the transparent separation region, the sensing signal is under the second status. When any light source irradiates the black bar region, the sensing signal is under the first status. When the any light source irradiates the magenta and the cyan dye frames, the sensing signal is under the first or the second status. In addition, according to the illustrative embodiment, the photo sensor and the light source are set on different sides of the ribbon. In practice, the photo sensor and the light source are able to be set on the same side of the ribbon as long as a reflection device is set at the opposite side for reflecting the beam emitted by the light source to generate corresponding sensing signals.

Figure 9:
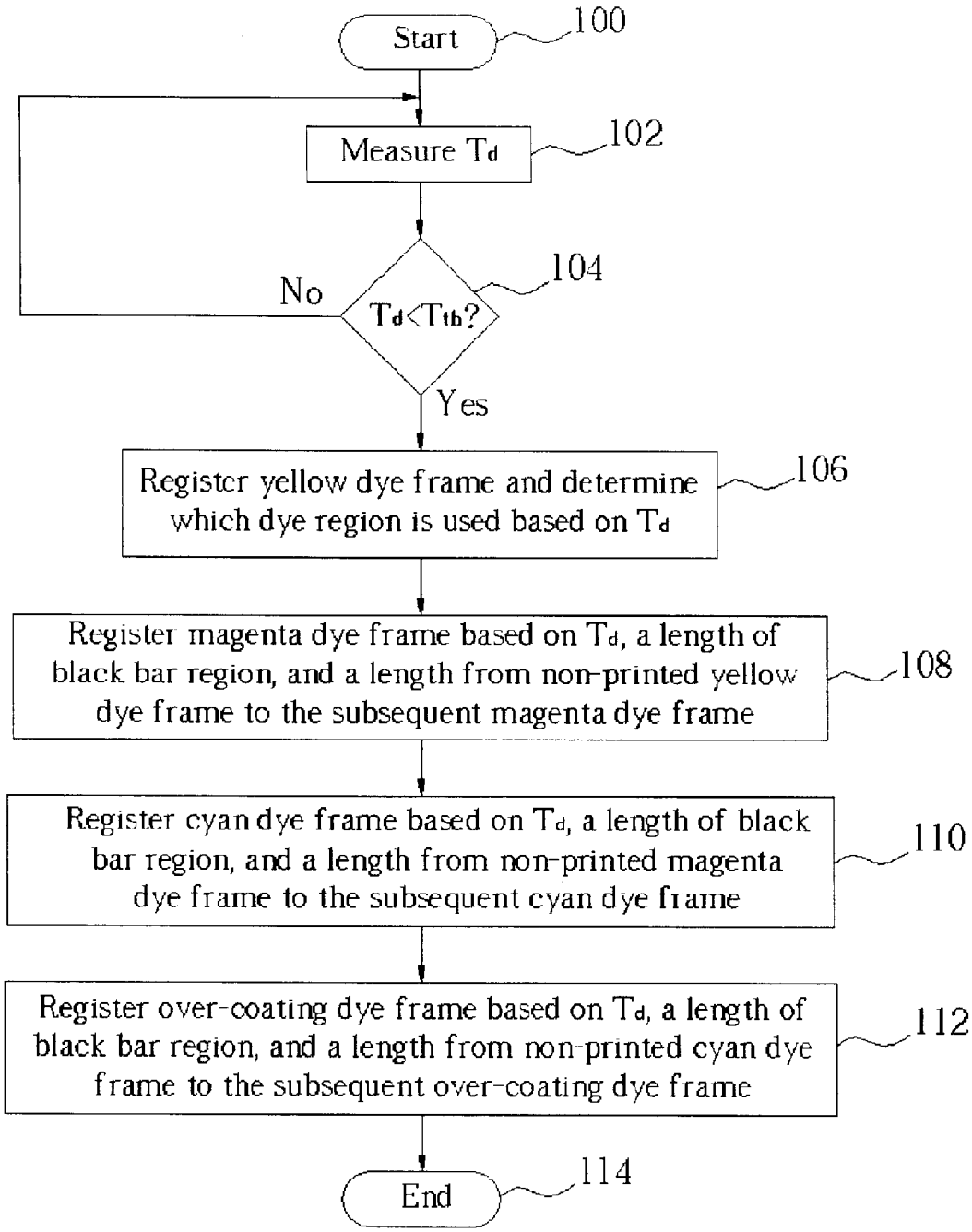
FIG. 9 is a flowchart of registering the ribbon and detecting the used amount of ribbon according to the present invention.

Please refer to FIG. 9, which is a flowchart of registering the ribbon and detecting the used amount of ribbon according to the present invention.

Step 100: Start;

Step 102: While the sensing signal is changed from high voltage level to low voltage level, detect the holding time Td for which the low voltage level holds;

Step 104: Determine whether the time Td is smaller than a predetermined time Tth, if it is, go to Step 106; if not, go to Step 102;

Step 106: Register the yellow dye frame and thus use the yellow dye frame for printing. At the same time, determine which dye region is used based on the time Td;

Step 108: Register the magenta dye frame and thus use the magenta dye frame for printing, based on a required time for moving to the subsequent magenta dye frame, which is calculated based on the time Td, a length from the non-printed part of the yellow frame to be just printed to the subsequent magenta dye frame, and a length of the black bar region;

Step 110: Register the cyan dye frame and thus use the cyan dye frame for printing, based on a required time for moving to the subsequent cyan dye frame, which is calculated based on the time Td, a length from the non-printed part of the magenta frame to be just printed to the subsequent cyan dye frame, and a length of the black bar region;

Step 112: Register the over-coating dye frame and thus use the over-coating dye frame for printing, based on a required time for moving to the subsequent over-coating dye frame, which is calculated based on the time Td, a length from the non-printed part of the cyan frame to be just printed to the subsequent over-coating dye frame, and a length of the black bar region; and Step 114: End.

Compared to the prior art, the present invention printer is able to measure the time in which the black bar region passes through the photo sensor and then, identify the amount of the ribbon used by taking advantage of the operation with constant angular velocity. Therefore, the user is able to know if there are enough dye regions in the dye region of the ribbon. Besides, the present invention is also able to identify the start position of each dye frame by taking advantage of the time for the black bar region to pass through the photo sensor. Consequently, the present invention is not only able to measure the amount of the ribbon used, but also identify the start position of each dye frame to meet the needs of registration without any extra hardware cost.

Those skilled in the art will readily observe that numerous modifications and alterations of the method may be made while retaining the teachings of the invention. Accordingly, the above disclosure should be construed as limited only by the metes and bounds of the appended claims.

What is claimed is:

1. A method of registering the position of a ribbon by moving the ribbon with a constant angular velocity and detecting the amount of the ribbon used in a photo printer, the ribbon comprising a plurality of separation regions, a plurality of dye regions each having a plurality of dye frames, and a plurality of separation frames for dividing the dye frames;

the printer comprising:

a print head for transferring dye on the ribbon onto a media;

a ribbon-driving device for moving the ribbon in a predetermined direction with a constant angular velocity and for accommodating the ribbon; and a photo sensor, set besides the ribbon, for generating a corresponding sensing signal; wherein the sensing signal has a first status and a second status;

the method comprising:

detecting a length of time of the first status when the sensing signal changes its status from the second status to the first status;

determining an amount of ribbon used based on the length of time of the first status, if the length of time of the first status is shorter than a threshold, the first dye frame of the dye region is registered;

determining a required moving time for the ribbon to register a start position of a subsequent dye frame of the dye region based on the length of time of the first status used to register the first dye frame of a dye region, a total length of the printed part of the dye frame, and a length from non-printed part of the dye frame to the subsequent dye frame, while one of the dye frames of the dye region is finished printing.

2. The method of claim 1, wherein the ribbon driving device comprises a take-up spool and a supply spool, both for taping the ribbon; wherein determining the amount of ribbon used is based on the length of time of the first status if the length of time of the first status is shorter than the threshold, a length of the dye region, a length of the separation region between the two adjacent dye regions, a thickness of the ribbon, a radius of the take-up spool, and a rotation speed of the take-up spool and the supply spool.

3. The method of claim 1, wherein the printer further comprises a light source for emitting light toward the plurality of dye frames of the ribbon, and the photo sensor generates sensing signals when sensing a beam from the light source passes through the dye frames.

4. The method of claim 1, wherein a separation region is placed in front of each dye frame.

5. The method of claim 1, wherein the first status is a low level voltage status, and the second status is a high level voltage status.

6. The method of claim 1, wherein each dye region comprises a yellow dye frame, a magenta dye frame, a cyan dye frame, an over-coating dye frame, the separation region prior to the yellow dye frame being a black bar region, the separation regions prior to other dye frames being transparent separation regions.

7. The method of claim 6, wherein each dye frame is much longer than both the black bar region and the transparent separation regions.

8. The method of claim 6, wherein the light source is a green light LED, and wherein when the green light LED emits green light to illuminate the yellow dye frame, the over-coating dye frame, and the transparent separation region, the sensing signal is in the second status; when the green light LED emits green light to illuminate the magenta dye frame, the cyan dye frame, and the black bar region, the sensing signal is in the first status.

9. The method of claim 6, wherein the light source is a red light LED, and wherein when the red light LED emits red light to illuminate the yellow dye frame, the magenta dye frame, the over-coating dye frame, and the transparent separation region, the sensing signal is in the second status; when the red light LED emits red light to illuminate the cyan dye frame, and the black bar region, the sensing signal is in the first status.

10. The method of claim 6, wherein the light source can be any LED for emitting various color light, and wherein when the LED emits light to illuminate the yellow dye frame, the over-coating dye frame, and the transparent separation region, the sensing signal is in the second status; when the LED emits light to illuminate the black bar region, the sensing signal is in the first status; when the LED emits light to illuminate the magenta dye frame, and the cyan dye frame, the sensing signal can be in the first status or the second status.

11. A device for performing the method of claim 1.

* * * * *